US006896788B2

(12) United States Patent
Shindo et al.

(10) Patent No.: US 6,896,788 B2
(45) Date of Patent: May 24, 2005

(54) METHOD OF PRODUCING A HIGHER-PURITY METAL

(75) Inventors: Yuichiro Shindo, Ibaraki (JP); Syunichiro Yamaguchi, Ibaraki (JP); Kouichi Takemoto, Ibaraki (JP)

(73) Assignee: Nikko Materials Company, Limited, Tokyo (JP)

( * ) Notice: Subject to any disclaimer, the term of this patent is extended or adjusted under 35 U.S.C. 154(b) by 367 days.

(21) Appl. No.: 10/130,244

(22) PCT Filed: Feb. 6, 2001

(86) PCT No.: PCT/JP01/00817

§ 371 (c)(1),
(2), (4) Date: May 15, 2002

(87) PCT Pub. No.: WO01/90445

PCT Pub. Date: Nov. 29, 2001

(65) Prior Publication Data

US 2003/0019759 A1 Jan. 30, 2003

(30) Foreign Application Priority Data

May 22, 2000 (JP) ..... 2000-149589
Sep. 21, 2000 (JP) ..... 2000-286494
Nov. 10, 2000 (JP) ..... 2000-343468

(51) Int. Cl.[7] ..... C25C 1/00

(52) U.S. Cl. ..... 205/560; 205/563; 205/564; 205/565; 205/571; 205/572; 205/573; 205/574; 205/584; 205/597; 205/602; 205/610

(58) Field of Search ..... 205/560, 563, 205/564, 565, 571, 572, 573, 574, 584, 597, 602, 610

(56) References Cited

U.S. PATENT DOCUMENTS 3,049,478 A * 8/1962 Morawietz ..... 205/346
5,393,388 A * 2/1995 Herrmann et al. ..... 205/559
6,267,827 B1 7/2001 Shindo et al. ..... 148/312

FOREIGN PATENT DOCUMENTS

JP 02-185990 7/1990
JP 07-003486 * 1/1995
JP 11-335821 * 12/1999

OTHER PUBLICATIONS

Patent Abstracts of Japan, one page English language Abstract for JP 07–003486, Jan. 1995.

Patent Abstracts of Japan, one page English language Abstract for JP 02–185990, Jul. 1990.

Patent Abstracts of Japan, one page English language Abstract for JP 11–335821, Dec. 1999.

* cited by examiner

*Primary Examiner*—Arun S Phasge
(74) *Attorney, Agent, or Firm*—Howson and Howson

(57) ABSTRACT

A method of producing a higher purity metal comprising the step of electrolyzing a coarse metal material by a primary electrolysis to obtain a primary electrodeposited metal, the step of electrolyzing the material with the primary electrodeposited metal obtained in the primary electrolysis step used as an anode to obtain a higher purity electrolyte for secondary electrolysis, and the step of further performing secondary electrolysis by employing higher purity electrolytic solution than said electrolytic solution with said primary electrodeposited metal as an anode, whereby providing an electro-refining method that effectively uses electrodes and an electrolyte produced in a plurality of electro-refining steps, reuses the flow of an electrolyte in the system, reduces organic matter-caused oxygen content, and can effectively produce a high purity metal.

22 Claims, 1 Drawing Sheet

METHOD OF PRODUCING A HIGHER-PURITY METAL

FIELD OF THE INVENTION

The present invention relates to a method of producing higher purity metal which effectively uses electrodes and an electrolyte produced in a plurality of electrolytic steps, and performs primary electrolysis and secondary electrolysis, and, when necessary, tertiary electrolysis of reusing the flow of an electrolyte in the system.

Moreover, the present invention further relates to a method of higher purification effective in the higher purification of metal which reduces the oxygen content caused by organic matter.

Further, the present invention additionally relates to a method of producing a higher purity metal in which, among the metals to be produced in a higher purity pursuant to the foregoing methods, the total content of alkali metal elements such as Na, K is 1 ppm or less; the total content of radio active elements such as U, Th is 1 ppb or less; the total content of transition metal or heavy metal elements such as Fe, Ni, Cr, Cu, excluding cases of being contained as the principal component, is 10 ppm or less; and the remaining portion thereof becomes a higher purity metal or other indispensable impurities.

In addition, the %, ppm, ppb used in the present specification all refer to wt %, wtppm, wtppb.

BACKGROUND OF THE INVENTION

Conventionally, when producing a 4N or 5N (respectively implying 99.99 wt %, 99.999 wt %) level higher purity metal, the electro-refining method is often employed for the production thereof. Nevertheless, there are many cases where approximate elements remain as impurities when performing electrolysis to the target metal. For example, in the case of a transition metal such as iron, numerous elements such as nickel, cobalt and so on, which are also transition metals, are contained as impurities.

When refining such crude metals of a 3N level, electrolysis is performed upon producing a higher purity liquid.

In order to obtain a higher purity metal in the foregoing electrolysis, it is necessary to employ a method of ion exchange or solvent extraction for producing an electrolytic solution with few impurities.

As described above, the production of an electrolytic solution normally requires a refinement in advance prior to the electrolysis, and has a shortcoming in that the production cost therefor would become high.

OBJECT OF THE INVENTION

An object of the present invention is to provide an electrolysis method which effectively uses electrodes and an electrolyte produced in a plurality of electrolytic steps, reuses the flow of an electrolytic solution in the system, and thereby enables the effective production of a higher purity metal. Another object of the present invention is to further provide a method of producing a higher purity metal which effectively uses electrodes and an electrolyte produced in a plurality of electrolytic steps, reuses the flow of an electrolytic solution in the system, reduces organic matter-caused oxygen content, and thereby enables the effective production of a higher purity metal.

SUMMARY OF THE INVENTION

In order to achieve the foregoing objects, it has been discovered that by using an electrolytic solution, which was electrolyzed with the primary electrodeposited metal obtained by the primary electrolytic step as the anode, for the secondary electrolysis, the preparation of the electrolytic solution can be simplified, and a higher purity metal can be obtained pursuant to a plurality of electrolytic steps. In addition, by washing the electrolytic solution used above, the oxygen content caused by organic matter can be reduced.

Based on the foregoing discovery, the present invention provides:

1. A method of producing a higher purity metal comprising the step of electrolyzing a coarse metal material by primary electrolysis to obtain a primary electrodeposited metal, the step of performing electrochemical dissolution with the primary electrodeposited metal obtained in the primary electrolysis step as an anode or performing acid dissolution to the primary electrodeposited metal in order to obtain a higher purity electrolytic solution for secondary electrolysis, and the step of further performing secondary electrolysis by employing said higher purity electrolytic solution for secondary electrolysis with said primary electrodeposited metal as an anode;
2. A method of producing a higher purity metal comprising the step of electrolyzing a coarse metal material by primary electrolysis to obtain a primary electrodeposited metal, the step of obtaining a higher purity electrolytic solution for secondary electrolysis by performing electrochemical dissolution or acid dissolution with the primary electrodeposited metal obtained in the primary electrolysis step as an anode, and the step of further performing secondary electrolysis by employing said higher purity electrolytic solution for secondary electrolysis with said primary electrodeposited metal as an anode, wherein said electrolytic solution is liquid-circulated in an activated carbon tank in order to eliminate organic matter in the higher purity metal aqueous solution, thereby reducing the oxygen content caused by said organic matter to 30 ppm or less;
3. A method of producing a higher purity metal according to paragraph 1 or paragraph 2 above, wherein the coarse metal has a purity of 3N or less, the primary electrodeposited metal has a purity of 3N to 4N excluding gas components such as oxygen, and the higher purity metal obtained by the secondary electrolysis has a purity of 4N to 5N or more;
4. A method of producing a higher purity metal according to paragraph 1 or paragraph 2 above, wherein the coarse metal has a purity of 4N or less, the primary electrodeposited metal has a purity of 4N to 5N excluding gas components such as oxygen, and the higher purity metal obtained by the secondary electrolysis has a purity of 5N to 6N or more;
5. A method of producing a higher purity metal according to each of paragraphs 1 to 4 above, wherein the electrolytic solution after the secondary electrolysis step is used cyclically as the electrolytic solution of the primary electrolysis;
6. A method of producing a higher purity metal according to each of paragraphs 1 to 5 above, wherein the electrolytic solution after the primary electrolysis is either discharged outside the system or reused after refining the liquid;
7. A method of producing a higher purity metal according to each of paragraphs 1 to 6 above, comprising the step of electrolyzing the secondary electrodeposited metal obtained in the secondary electrolysis step as an anode or performing acid dissolution to the secondary electrodeposited metal in order to obtain a higher purity electrolytic solution for tertiary electrolysis, and the step of further performing tertiary electrolysis by employing said higher purity electrolytic solution for tertiary electrolysis with said secondary electrodeposited metal as an anode;

8. A method of producing a higher purity metal according to each of paragraphs 1 to 7 above, wherein, among the higher purity metal, the total content of alkali metal elements such as Na, K is 1 ppm or less; the total content of radio active elements such as U, Th is 1 ppb or less; the total content of transition metal or heavy metal elements such as Fe, Ni, Cr, Cu is 10 ppm or less; and the remaining portion thereof becomes a higher purity metal or other indispensable impurities;
9. A method of producing a higher purity metal according to each of paragraphs 1 to 8 above, wherein the C content is 30 ppm or less and the S content is 1 ppm or less; and
10. A method of producing a higher purity metal according to each of paragraphs 1 to 9 above, wherein the electrodeposited metal is further dissolved in a vacuum or dissolved under an Ar atmosphere or an Ar—$H_2$ atmosphere.

BEST DESCRIPTION OF THE PREFERRED EMBODIMENTS

Figure 1:
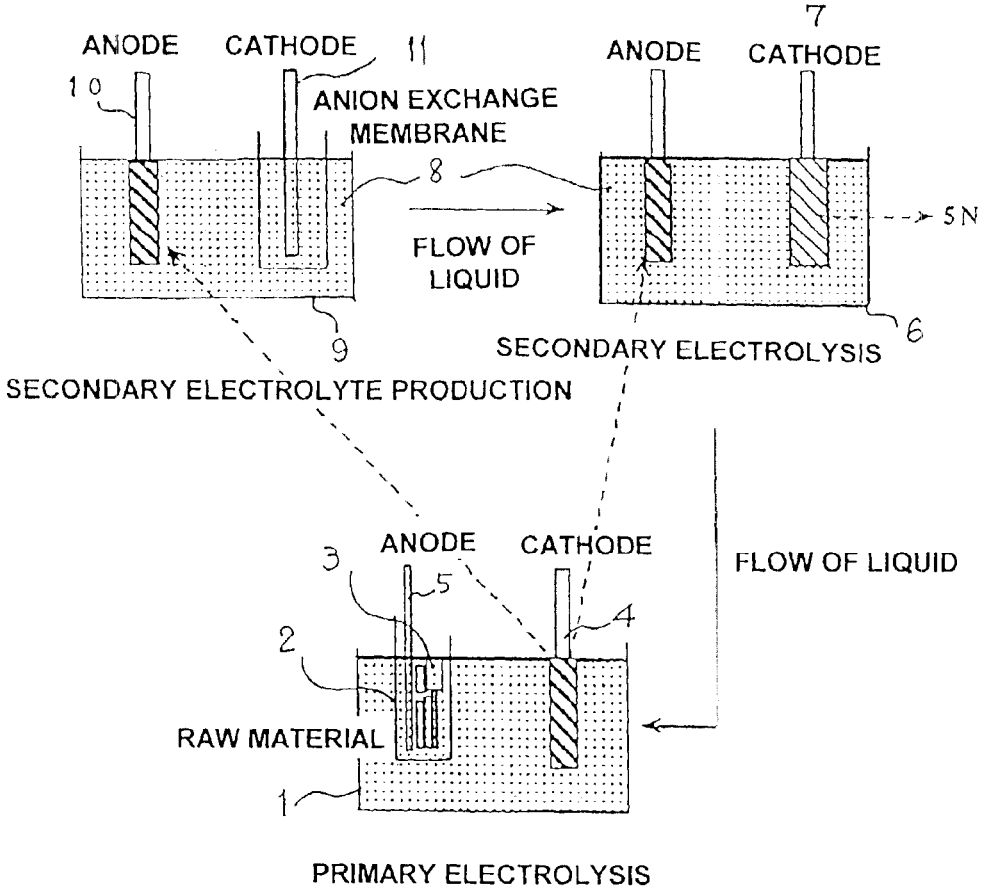
FIG. 1 is a diagram illustrating the outline of the primary electrolysis step, secondary electrolysis step, and the production step of the electrolytic solution for the secondary electrolysis.

The present invention is now described with reference to FIG. 1. FIG. 1 is a diagram illustrating the outline of the primary electrolysis step, secondary electrolysis step, and the production step of the electrolytic solution for the secondary electrolysis.

As shown in FIG. 1, a crude metallic material 3 (3N or less, or 4N or less) such as a metal scrap is placed in an anode basket 2 in the primary electrolytic tank 1, and a primary electrodeposited metal is deposited to a cathode 4 by electrolyzing the crude metallic material. Here, the initial electrolytic solution is prepared in advance. Purity of the primary electrodeposited metal pursuant to this primary electrolysis is 3N to 4N or 4N to 5N.

Next, the primary electrodeposited metal deposited to the cathode 4 is electrolyzed as an anode 5 in the electrolytic tank 6 in order to obtain a secondary electrodeposited metal in a cathode 7.

In this case, the aforementioned primary electrodeposited metal as the anode 10 in a secondary electrolytic solution production tank 9 is electrolyzed to produce the electrolytic solution 8. The cathode 11 in this secondary electrolytic solution production tank 9 is insulated with an anion exchange membrane such that the metal from the anode 10 is not deposited. Moreover, acid dissolution may be performed to the primary electrodeposited metal in a separate container in order to conduct pH adjustment.

As depicted in FIG. 1, the electrolytic solution 8 produced as described above is used in the secondary electrolysis. A higher purity electrolytic solution can thereby be produced relatively easily, and the production cost can be significantly reduced. Further, the spent electrolytic solution used in the secondary electrolytic tank 6 is returned to the primary electrolytic tank 1 and used as the primary electrolytic solution.

The metal deposited to the cathode 7 in the secondary electrolytic tank 6 has a purity of a 5N level or 6N level.

When seeking a higher purity, or when the target purity could not be obtained in the electro-refining process pursuant to the foregoing secondary electrolysis, a tertiary electrolysis may be performed.

This step is similar to the case of the foregoing secondary electrolysis. In other words, a tertiary electrodeposited solution is produced with the secondary electrodeposited metal deposited to the cathode in the secondary electrolysis as the anode of the tertiary electrolytic tank (not shown), or with the secondary electrodeposited metal as the anode, and a tertiary electrodeposited solution is deposited to the cathode of the tertiary electrolytic tank with this tertiary electrolytic solution as the electrolytic solution. The purity of the electrodeposited metal is sequentially improved as described above.

Similarly, the used tertiary electrolytic solution may be used as the electrolytic solution of the secondary electrolytic tank or primary electrolytic tank.

The foregoing electrolytic solution may be entirely liquid-circulated in the activated carbon tank in order to eliminate organic matter in the higher purity metal aqueous solution. The oxygen content caused by organic matter may thereby be reduced to 30 ppm or less.

The electro-refining of the present invention is applicable to the electro-refining of metal elements such as iron, cadmium, zinc, copper, manganese, cobalt, nickel, chrome, silver, gold, lead, tin, indium, bismuth, gallium, and so on.

EXAMPLES AND COMPARATIVE EXAMPLES

Examples of the present invention are now described. These Examples are merely illustrative, and the present invention shall in no way be limited thereby. In other words, the present invention shall include all other modes or modifications other than these Examples within the scope of the technical spirit of this invention.

Example 1

An electrolytic tank as shown in FIG. 1 was used to perform electrolysis with a 3N level massive iron as the anode, and a 4N level iron as the cathode.

Electrolysis was implemented with a bath temperature of 50° C., hydrochloric electrolytic solution at pH2, iron concentration of 50 g/L, and current density of 1A/$dm^2$. Obtained thereby was electrolytic iron (deposited to the cathode) having a current efficiency of 90% and a purity level of 4N.

Next, this electrolytic iron was dissolved with a mixed solution of hydrochloric acid and hydrogen peroxide solution, and made into an electrolytic solution for secondary electrolysis by adjusting pH with ammonia. Further, a second electrolysis (secondary electrolysis) was implemented with the 4N level primary electrolytic iron deposited to the foregoing cathode as the anode.

Conditions for the electrolysis are the same as those for the primary electrolysis. Electrolysis was implemented with a bath temperature of 50° C., hydrochloric electrolytic solution at pH2, and iron concentration of 50 g/L. As a result, obtained was electrolytic iron (deposited to the cathode) having a current efficiency of 92% and a purity level of 5N.

Analytical results of the primary electrolytic iron and secondary electrolytic iron are shown in Table 1. In the primary electrolytic iron, Al: 2 ppm, As: 3 ppm, Co: 7 ppm, Ni: 5 ppm, Cu: 1 ppm and Al: 2 ppm existed as impurities. In the secondary electrolysis, however, excluding the existence of Co: 2 ppm, all other impurities were 1 ppm or less. Moreover, the used secondary electrolytic solution could be returned to the primary electrolytic solution and used again.

As described above, superior results were yielded in that higher purity (5N) iron was produced with two electrolytic refining processes, and the production of electrolytic liquid could be facilitated.

TABLE 1

(ppm)

| Impurity | Al | As | B | Co | Cr | Ni |
|---|---|---|---|---|---|---|
| Raw Material | 20 | 30 | 15 | 35 | 1 | 20 |
| 4N | 2 | 3 | <1 | 7 | <1 | 5 |
| 5N | <1 | <1 | <1 | 2 | <1 | 1 |
| Impurity | Zn | Cu | Al | O | C | N |
| Raw Material | 15 | 12 | 25 | 200 | 30 | 30 |
| 4N | <1 | 1 | 2 | 50 | 10 | 10 |
| 5N | <1 | <1 | <1 | 50 | 10 | <10 |

Example 2

Similar to aforementioned Example 1, an electrolytic tank as shown in FIG. 1 was used to perform electrolysis with a 3N level massive cadmium as the anode, and titanium as the cathode.

Electrolysis was implemented with a bath temperature of 30° C., sulfuric acid of 80 g/L, cadmium concentration of 70 g/L, and current density of 1A/dm$^2$. Obtained thereby was electrolytic cadmium (deposited to the cathode) having a current efficiency of 85% and a purity level of 4N.

Next, this electrolytic cadmium was electrolyzed with a sulfate bath, and made into an electrolytic solution for secondary electrolysis. Further, a second electrolysis (secondary electrolysis) was implemented with the 4N level primary electrolytic cadmium deposited to the foregoing cathode as the anode.

Conditions for the electrolysis are the same as those for the primary electrolysis. Electrolysis was implemented with a bath temperature of 30° C., sulfuric acid of 80 g/L, cadmium concentration of 70 g/L, and current density of 1A/dm$^2$. As a result, obtained was electrolytic cadmium having a current efficiency of 92% and a purity level of 5N.

Analytical results of the primary electrolytic cadmium and secondary electrolytic cadmium are shown in Table 2. In the primary electrolytic cadmium, Ag: 2 ppm, Pb: 10 ppm, Cu: 1 ppm and Fe: 20 ppm existed as impurities. In the secondary electrolysis, however, excluding the existence of Pb: 2 ppm and Fe: 3 ppm, all other impurities were 1 ppm or less.

Moreover, similar to Example 1 above, the used secondary electrolytic solution could be returned to the primary electrolytic solution and used again.

As described above, superior results were yielded in that higher purity (5N) cadmium was produced with two electrolytic refining processes, and the production of electrolytic liquid could be facilitated.

TABLE 2

(ppm)

| | Ag | Pb | Cu | Zn | Fe |
|---|---|---|---|---|---|
| Raw Material | 19 | 50 | 16 | 3 | 145 |
| 4N | 2 | 10 | 1 | <1 | 20 |
| 5N | <1 | 2 | <1 | <1 | 3 |

Example 3

Similar to aforementioned Example 1, an electrolytic tank as shown in FIG. 1 was used to perform electrolysis with a 3N level massive cobalt as the anode, and a 4N level cobalt as the cathode.

Electrolysis was implemented with a bath temperature of 40° C., hydrochloric electrolytic solution at pH2, cobalt concentration of 100 g/L, current density of 1A/dm$^2$, and an electrolyzing time of 40 hours. Obtained thereby was approximately 1 kg of electrolytic cobalt (deposited to the cathode) having a current efficiency of 90%. The purity level thereof was 4N.

Next, this electrolytic cobalt was dissolved with sulfuric acid, and made into an electrolytic solution for secondary electrolysis by adjusting to pH with ammonia. Further, a second electrolysis (secondary electrolysis) was implemented with the 4N level primary electrolytic cobalt deposited to the foregoing cathode as the anode.

Conditions for the electrolysis are the same as those for the primary electrolysis, and electrolysis was implemented with a bath temperature of 40° C., hydrochloric electrolytic solution at pH2, and cobalt concentration of 100 g/L. As a result, obtained was electrolytic cobalt having a current efficiency of 92% and a purity level of 5N.

Analytical results of the primary electrolytic cobalt and secondary electrolytic cobalt are shown in Table 3. In the raw material cobalt, Na: 10 ppm, K: 1 ppm, Fe: 10 ppm, Ni: 500 ppm, Cu: 2.0 ppm, Al: 3.0 ppm, Cr: 0.1 ppm, S: 1 ppm, U: 0.2 ppb, and Th: 0.1 ppb existed as impurities. In the primary electrolysis, however, excluding the existence of Fe: 5 ppm and Ni: 50 ppm, all other impurities were 0.1 ppm or less.

Further, in the secondary electrolysis, excluding the existence of Fe: 2 ppm and Ni: 3 ppm, all other impurities were less than 0.1 ppm, thereby representing a significant decrease in impurities.

The used secondary electrolytic solution could be returned to the primary electrolytic solution and used again.

As described above, superior results were yielded in that higher purity (5N) cobalt was produced with two electrolytic refining processes, and the production of electrolytic liquid could be facilitated.

TABLE 3

(U, Th: ppb, Others: ppm)

| | Na | K | Fe | Ni | Cu |
|---|---|---|---|---|---|
| Raw Material | 10 | 1 | 10 | 500 | 2.0 |
| Primary | 0.1 | <0.1 | 5 | 50 | <0.1 |
| Secondary | <0.1 | <0.1 | 2 | 3 | <0.1 |
| | Al | Cr | S | U | Th |
| Raw Material | 3.0 | 0.1 | 1 | 0.2 | 0.1 |
| Primary | 0.1 | <0.01 | <0.1 | <0.1 | <0.1 |
| Secondary | <0.01 | <0.01 | <0.1 | <0.1 | <0.1 |

Primary: primary electrolysis
Secondary: secondary electrolysis

Example 4

Similar to aforementioned Example 1, an electrolytic tank as shown in FIG. 1 was used to perform electrolysis with a 4N level massive nickel as the anode, and a 4N level nickel as the cathode.

Electrolysis was implemented with a bath temperature of 40° C., hydrochloric electrolytic solution at pH2, nickel concentration of 50 g/L, current density of 1A/dm$^2$, and an electrolyzing time of 40 hours. Obtained thereby was approximately 1 kg of electrolytic nickel (deposited to the cathode) having a current efficiency of 90%. The purity level thereof was 5N.

Next, this electrolytic nickel was dissolved with sulfuric acid, and made into an electrolytic solution for secondary electrolysis by adjusting to pH with ammonia. Further, a second electrolysis (secondary electrolysis) was implemented with the 5N level primary electrolytic nickel deposited to the foregoing cathode as the anode.

Conditions for the electrolysis are the same as those for the primary electrolysis, and electrolysis was implemented with a bath temperature of 40° C., hydrochloric electrolytic solution at pH2, and nickel concentration of 50 g/L. As a result, obtained was electrolytic nickel having a current efficiency of 92% and a purity level of 6N.

Analytical results of the primary electrolytic nickel and secondary electrolytic nickel are shown in Table 4. In the raw material nickel, Na: 16 ppm, K: 0.6 ppm, Fe: 7 ppm, Co: 0.55 ppm, Cu: 0.62 ppm, Al: 0.04 ppm, Cr: 0.01 ppm, S: 1 ppm, U: 0.2 ppb, and Th: 0.1 ppb existed as impurities. In the primary electrolysis, however, excluding the existence of Fe: 2 ppm and Co: 0.2 ppm, all other impurities were 0.1 ppm or less.

Further, in the secondary electrolysis, only Fe: 0.2 ppm existed, and all other impurities were less than 0.1 ppm, thereby representing a significant decrease in impurities. The used secondary electrolytic solution could be returned to the primary electrolytic solution and used again.

As described above, superior results were yielded in that higher purity (6N) nickel was produced with two electrolytic refining processes, and the production of electrolytic liquid could be facilitated.

TABLE 4

(U, Tb: ppb, Others: ppm)

| | Na | K | Fe | Co | Cu |
|---|---|---|---|---|---|
| Raw Material | 16 | 0.6 | 7 | 0.55 | 0.62 |
| Primary | 0.1 | <0.1 | 2 | 0.2 | <0.1 |
| Secondary | <0.1 | <0.1 | 0.2 | <0.1 | <0.1 |
| | **Al** | **Cr** | **S** | **U** | **Th** |
| Raw Material | 0.04 | 0.01 | 1 | 0.2 | 0.1 |
| Primary | <0.01 | <0.01 | <0.1 | <0.1 | <0.1 |
| Secondary | <0.01 | <0.01 | <0.1 | <0.1 | <0.1 |

Primary: primary electrolysis
Secondary: secondary electrolysis

Example 5

A 4N level raw material cobalt differing from the cobalt used above was used to perform a separate primary electrolysis and secondary electrolysis, and, thereupon, the electrolytic solution was circulated in the activated carbon tank in order to eliminate the organic matter in the higher purity metal aqueous solution. The analytical results of the impurity elements obtained pursuant to the aforementioned refining are shown in Table 5.

As impurities contained in the electrolytic cobalt pursuant to the foregoing primary electrolysis and secondary electrolysis, only Ti: 1.8 ppm, Fe: 1.3 ppm and Ni: 4.2 ppm existed as impurities exceeding 1 ppm, and, excluding gas components such as oxygen, all other impurities were less than 0.1 ppm, thereby representing a significant decrease in impurities.

The used secondary electrolytic solution could be returned to the primary electrolytic solution and used again. Although not shown in Table 5, oxygen was significantly eliminated with activated carbon, and was reduced to 30 ppm or less.

As described above, superior results were yielded in that higher purity (5N) cobalt was produced with two electrolytic refining processes, and the production of electrolytic liquid could be facilitated.

TABLE 5

Content: ppm (weight)

| Element | Content | Element | Content | Element | Content |
|---|---|---|---|---|---|
| Li | <0.005 | As | 0.03 | Sm | <0.005 |
| Be | <0.005 | Se | <0.05 | Eu | <0.005 |
| B | <0.01 | Br | <0.05 | Gd | <0.005 |
| F | <0.05 | Rb | <0.005 | Tb | <0.005 |
| Na | <0.01 | Sr | <0.005 | Dy | <0.005 |
| Mg | <0.005 | Y | <0.001 | Ho | <0.005 |
| Al | 0.13 | Zr | <0.005 | Er | <0.005 |
| Si | 0.03 | Nb | <0.01 | Tm | <0.005 |
| P | 0.3 | Mo | 0.12 | Yb | <0.005 |
| S | 0.17 | Ru | <0.01 | Lu | <0.005 |
| Cl | 0.05 | Rh | <0.01 | Hf | <0.005 |
| K | <0.01 | Pd | <0.05 | Ta | <1 |
| Ca | <0.05 | Ag | <0.01 | W | <0.05 |
| Sc | <0.001 | Cd | <0.05 | Re | <0.01 |
| Ti | 1.8 | In | <0.01 | Os | <0.005 |
| V | <0.001 | Sn | <0.01 | Ir | <0.01 |
| Cr | 0.32 | Sb | <0.01 | Pt | <0.01 |
| Mn | <0.01 | Te | <0.05 | Au | <0.05 |
| Fe | 1.3 | I | <0.01 | Hg | <0.05 |
| Co | Matrix | Cs | <0.01 | Tl | <0.01 |
| Ni | 4.2 | Ba | <0.05 | Pb | <0.01 |
| Cu | 0.05 | La | <0.1 | Bi | <0.005 |
| Zn | 0.03 | Ce | <0.005 | Th | <0.0001 |
| Ga | <0.05 | Pr | <0.005 | U | <0.0001 |
| Ge | <0.1 | Nd | <0.005 | | |

As described above, superior characteristics are yielded in that the primary electrodeposited metal as an anode is electrolyzed in order to produce a secondary electrolytic solution, and, further, by using such primary electrodeposited metal as the secondary electrolytic anode, higher purity electro-refining of 5N to 6N level is realized in addition to enabling the reduction of production costs of the secondary electrolytic solution of 4N to 5N level.

Moreover, a further superior effect is yielded in that the spent electrolytic solution used in the secondary electrolytic tank is returned to the primary electrolytic tank and may be used as the primary electrolytic solution, whereby the oxygen content can be reduced to 30 ppm or less.

What is claimed is:

1. A method of producing a higher purity metal, comprising the steps of:

(a) electrolyzing a crude metallic material by primary electrolysis to obtain a primary electrodeposited metal, (b) obtaining a higher purity electrolytic solution for secondary electrolysis by performing electrochemical dissolution using said primary electrodeposited metal obtained in the primary electrolysis of step (a) as an anode with a cathode insulated by an ion exchange membrane, and (c) performing a secondary electrolysis by employing said higher purity electrolytic solution for secondary electrolysis produced in step (b) with said primary electrodeposited metal produced in step (a) as an anode.

2. A method according to claim 1, wherein said crude metallic material has a purity of 3N or less, wherein the primary electrodeposited metal has a purity of 3N to 4N excluding gas components which includes oxygen, and the higher purity metal obtained by the secondary electrolysis has a purity of 4N to 5N or more.

3. A method according to claim 1, wherein said crude metallic material has a purity of 4N or less, wherein the primary electrodeposited metal has a purity of 4N to 5N excluding gas components which includes oxygen, and the higher purity metal obtained by the secondary electrolysis has a purity of 5N to 6N or more.

4. A method according to claim 1, wherein, after said secondary electrolysis step, said electrolytic solution is used cyclically as the electrolytic solution of the primary electrolysis.

5. A method according to claim 1, wherein an electrolytic solution remaining after said primary electrolysis step is one of discharged and reused after being refined.

6. A method according to claim 1, further comprising the steps of:

(d) obtaining a secondary electrodeposited metal during said secondary electrolysis step;

(e) electrolyzing said secondary electrodeposited metal produced in step (d) to obtain a higher purity electrolytic solution for tertiary electrolysis, and (f) performing a tertiary electrolysis by employing said higher purity electrolytic solution for tertiary electrolysis produced in step (e) with said secondary electrodeposited metal produced in step (d) as an anode.

7. A method according to claim 1, further comprising the steps of:

(g) obtaining a secondary electrodeposited metal during said secondary electrolysis step;

(e) performing acid dissolution to said secondary electrodeposited metal produced in step (d) to obtain a higher purity electrolytic solution for tertiary electrolysis, and (f) performing a tertiary electrolysis by employing said higher purity electrolytic solution for tertiary electrolysis produced in step (e) with said secondary electrodeposited metal produced in step (d) as an anode.

8. A method according to claim 1, wherein the higher purity metal formed by the method has a total content of alkali metal elements including Na and K of 1 ppm or less, a total content of radio active elements including U and Th of 1 ppb or less, a total content of transition and heavy metal elements including Fe, Ni, Cr and Cu of 10 ppm or less; and a remaining portion thereof being one of a higher purity metal and other indispensable impurities.

9. A method according to claim 1, wherein a C content of the higher purity metal is 30 ppm or less and an S content is 1 ppm or less.

10. A method according to claim 1, further comprising a step of dissolving said primary electrodeposited metal in one of a vacuum, an Ar atmosphere, and an Ar—$H_2$ atmosphere.

11. A method according to claim 1, wherein said electrolytic solution is liquid-circulated in an activated carbon tank to eliminate organic matter in the higher purity metal aqueous solution, thereby reducing the oxygen content caused by said organic matter to 30 ppm or less.

12. A method of producing a higher purity metal, comprising the steps of:

(a) electrolyzing a crude metallic material by primary electrolysis to obtain a primary electrodeposited metal, (b) obtaining a higher purity electrolytic solution for secondary electrolysis by performing acid dissolution with the primary electrodeposited metal obtained in the primary electrolysis of step (a), and (c) performing a secondary electrolysis by employing said higher purity electrolytic solution for secondary electrolysis produced in step (b) with said primary electrodeposited metal produced in step (a) as an anode, said electrolytic solution being liquid-circulated in an activated carbon tank to eliminate organic matter in the higher purity metal aqueous solution, thereby reducing the oxygen content caused by said organic matter to 30 ppm or less.

13. A method according to claim 12, wherein said crude metallic material has a purity of 3N or less, wherein the primary electrodeposited metal has a purity of 3N to 4N excluding gas components which includes oxygen, and the higher purity metal obtained by the secondary electrolysis has a purity of 4N to 5N or more.

14. A method according to claim 12, wherein said crude metallic material has a purity of 4N or less, wherein the primary electrodeposited metal has a purity of 4N to 5N excluding gas components which includes oxygen, and the higher purity metal obtained by the secondary electrolysis has a purity of 5N to 6N or more.

15. A method according to claim 12, wherein, after said secondary electrolysis step, said electrolytic solution is used cyclically as the electrolytic solution of the primary electrolysis.

16. A method according to claim 12, wherein an electrolytic solution remaining after said primary electrolysis step is one of discharged and reused after being refined.

17. A method according to claim 12, further comprising the steps of:

(d) obtaining a secondary electrodeposited metal during said secondary electrolysis step;

(e) electrolyzing said secondary electrodeposited metal produced in step (d) to obtain a higher purity electrolytic solution for tertiary electrolysis, and (f) performing a tertiary electrolysis by employing said higher purity electrolytic solution for tertiary electrolysis produced in step (e) with said secondary electrodeposited metal produced in step (d) as an anode.

18. A method according to claim 12, further comprising the steps of:

(d) obtaining a secondary electrodeposited metal during said secondary electrolysis step;

(e) performing acid dissolution to said secondary electrodeposited metal produced in step (d) to obtain a higher purity electrolytic solution for tertiary electrolysis, and (f) performing a tertiary electrolysis by employing said higher purity electrolytic solution for tertiary electrolysis produced in step (e) with said secondary electrodeposited metal produced in step (d) as an anode.

19. A method according to claim 12, wherein the higher purity metal formed by the method has a total content of alkali metal elements including Na and K of 1 ppm or less, a total content of radio active elements including U and of 1 ppb or less, a total content of transition and heavy metal elements including Fe, Ni, Cr and Cu of 10 ppm or less; and a remaining portion thereof being one of a higher purity metal, and other indispensable impurities.

20. A method according to claim 12, wherein a C content of the higher purity metal is 30 ppm or less and an S content is 1 ppm or less.

21. A method according to claim 12, further comprising a step of melting said primary electrodeposited metal in one of a vacuum, an Ar atmosphere, and an Ar—$H_2$ atmosphere.

22. A method of producing a higher purity metal, comprising the steps of:

(a) electrolyzing a crude metallic material by primary electrolysis to obtain a primary electrodeposited metal, (b) obtaining a higher purity electrolytic solution for secondary electrolysis by performing acid dissolution of said primary electrodeposited metal obtained in the primary electrolysis of step (a), and (c) performing a secondary electrolysis by employing said higher purity electrolytic solution for secondary electrolysis produced in step (b) with said primary electrodeposited metal produced in step (a) as an anode.

* * * * *

UNITED STATES PATENT AND TRADEMARK OFFICE

CERTIFICATE OF CORRECTION

PATENT NO. : 6,896,788 B2
DATED : May 24, 2005
INVENTOR(S) : Shindo et al.

It is certified that error appears in the above-identified patent and that said Letters Patent is hereby corrected as shown below:

Column 7,
Line 36 (Table 4), "(U, Tb:" should read -- (U, Th: --.

Column 9,
Line 26, "(g) obtaining" should read -- (d) obtaining --.

Column 10,
Line 51, "U and of" should read -- U and Th of --.

Signed and Sealed this

Twenty-second Day of November, 2005

JON W. DUDAS
*Director of the United States Patent and Trademark Office*

UNITED STATES PATENT AND TRADEMARK OFFICE

CERTIFICATE OF CORRECTION

PATENT NO. : 6,896,788 B2
DATED : May 24, 2005
INVENTOR(S) : Shindo et al.

It is certified that error appears in the above-identified patent and that said Letters Patent is hereby corrected as shown below:

Column 7,
Line 36 (Table 4), "(U, Tb:" should read -- (U, Th: --.

Column 9,
Line 26, "(g) obtaining" should read -- (d) obtaining --.

Column 10,
Line 51, "U and of" should read -- U and Th of --.

Signed and Sealed this

Seventh Day of February, 2006

JON W. DUDAS
*Director of the United States Patent and Trademark Office*